US011026558B2

(12) United States Patent
Kim et al.

(10) Patent No.: US 11,026,558 B2
(45) Date of Patent: Jun. 8, 2021

(54) HOME APPLIANCE

(71) Applicant: SAMSUNG ELECTRONICS CO., LTD., Suwon-si (KR)

(72) Inventors: Jin Doo Kim, Suwon-si (KR); Ki Tae Park, Suwon-si (KR); Hyun-Woo Yu, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/684,957

(22) Filed: Nov. 15, 2019

(65) Prior Publication Data

US 2020/0154974 A1 May 21, 2020

(30) Foreign Application Priority Data

Nov. 15, 2018 (KR) ..... 10-2018-0140869

(51) Int. Cl.
*A47L 15/42* (2006.01)

(52) U.S. Cl.
CPC ..... *A47L 15/4265* (2013.01); *A47L 15/4259* (2013.01); *A47L 15/4261* (2013.01)

(58) Field of Classification Search
CPC ..... A47L 15/42; A47L 15/4265
USPC ..... 312/204, 228, 348.4
See application file for complete search history.

(56) References Cited

U.S. PATENT DOCUMENTS

| | | | | |
|---|---|---|---|---|
| 5,383,724 | A | 1/1995 | Wrangberth et al. | |
| 8,511,761 | B2 | 8/2013 | Numanoglu | |
| 10,390,681 | B2 * | 8/2019 | Klusek | A47B 96/00 |
| 2019/0053685 | A1 * | 2/2019 | Chwalibog | A47L 15/4293 |

FOREIGN PATENT DOCUMENTS

| | | | | |
|---|---|---|---|---|
| EP | 0819404 | * | 1/1998 | A47L 15/42 |
| EP | 0 873 715 | A1 | 4/1998 | |
| EP | 1 364 609 | B1 | 5/2002 | |
| EP | 1 529 482 | B1 | 11/2003 | |
| EP | 1 875 850 | A1 | 7/2006 | |
| EP | 1 894 509 | B1 | 8/2006 | |
| EP | 2110064 | * | 3/2011 | A47L 15/42 |
| JP | 5-115408 | | 5/1993 | |
| JP | 7-31572 | | 2/1995 | |
| JP | 8-206051 | | 8/1996 | |
| JP | 3149323 | | 3/2001 | |
| KR | 10-0123375 | B1 | 11/1997 | |
| WO | 2010/076200 | A1 | 7/2010 | |
| WO | 2011/039225 | A1 | 4/2011 | |
| WO | 2011/080236 | A1 | 7/2011 | |
| WO | 2018/001496 | A1 | 1/2018 | |

OTHER PUBLICATIONS

International Search Report dated Mar. 16, 2020, in corresponding International Patent Application No. PCT/KR2019/015622.

* cited by examiner

*Primary Examiner* — James O Hansen
(74) *Attorney, Agent, or Firm* — Staas & Halsey LLP

(57) ABSTRACT

Provided is a home appliance including: a main body having a cavity; a door rotatably coupled to a front side of the main body to open and close the cavity; a holder moveably mounted to the door; a decorative plate mounted to the holder to be disposed on a front surface of the door; and a wire connected to the holder and the main body to vary a tension depending rotation of the door, and configured to move the holder by the tension.

16 Claims, 10 Drawing Sheets

HOME APPLIANCE

CROSS-REFERENCE TO RELATED APPLICATION

This application is based on and claims priority under 35 U.S.C. § 119 to Korean Patent Application No. 10-2018-0140869, filed on Nov. 15, 2018 in the Korean Intellectual Property Office, the disclosure of which is incorporated herein by reference.

BACKGROUND

1. Field

The disclosure relates to a home appliance having a door rotatably coupled to a main body to open and close a cavity, and more specifically, to a home appliance enabling a decorative plate coupled to a front surface of the door to be movable at a time of rotation of the door is rotated.

2. Description of the Related Art

In the case of a home appliance, such as a dishwasher having a washing tub for washing dishes or a cooking appliance having a cooking space for cooking foods, a door for opening and closing the washing tub or the cooking space may be rotatably coupled to a main body of the home appliance.

Among the home appliances, a built-in type home appliance disposed adjacent to furniture, such as a sink or a chest of drawers, has a decorative plate attached to a door that matches with a design of the adjacent furniture.

When the home appliance is arranged to correspond to the height of the adjacent furniture, a step difference occurs between a lower end of the door and the floor on which the home appliance is installed, and the decorative plate may be disposed such that a lower end thereof is positioned lower than the lower end of the door. In this case, when the door is opened, the lower end of the decorative plate may interfere with a lower portion of the main body.

SUMMARY

Therefore, it is an object of the present disclosure to provide a home appliance that allows a decorative plate attached to a front surface of a door to be moved in an upper direction of the door when the door is opened to prevent the decorative plate from interfering with a main body, and allows the decorative plate to return its original position when the door is closed.

It is another object of the disclosure to provide a home appliance that allows a decorative plate to be attached to a front surface of a door by a simple and easy method without using a separate fastening member, such as a screw.

Additional aspects of the invention will be set forth in part in the description which follows and, in part, will be obvious from the description, or may be learned by practice of the invention.

Therefore, it is an aspect of the disclosure to provide a home appliance including: a main body having a cavity; a door rotatably coupled to a front side of the main body to open and close the cavity; a holder moveably mounted to the door; a decorative plate mounted to the holder to be disposed on a front surface of the door; and a wire connected to the holder and the main body such that a tension thereof varies depending rotation of the door, and configured to move the holder by the tension.

A tension may be applied to the door when the door is opened, and the tension of the door may be removed when the door is closed.

The holder may be moved in an upper direction of the door by the tension of the wire when the door is opened.

The door may be provided with a guide slot for guiding movement of the holder, and the holder may be inserted into the guide slot and moves along the guide slot.

The home appliance may further include a direction conversion member configured to convert a direction of a force exerted on the holder by the tension of the wire.

The home appliance may further include a wire guide member configured to guide a position of the guide.

The wire guide member may be configured to adjust the tension of the wire at a time of rotation of the door.

The decorative plate may be moved in a lower direction of the door by self-weight of the decorative plate when the door is closed.

The home appliance may further include another wire connected to the holder such that the holder is moved in a lower direction of the door when the door is closed.

The home appliance may further include an elastic member connected to the other wire to elastically support the other wire.

The home appliance may further include an installation bracket coupled to the door to cover and support the elastic member.

The home appliance may further include a fixer coupled to the decorative plate such that the decorative plate is mounted to the holder.

The holder may include a fixer accommodation groove having an upper surface that is open such that the fixer is inserted into the fixer accommodation groove in a downward direction.

The holder may further include a stopper coupled to the fixer such that the fixer is prevented from being separated from the fixer accommodation groove.

The holder may include an elastic pressing portion elastically supporting the stopper.

It is another aspect of the disclosure to provide a home appliance including: a main body having a cavity; a door rotatably coupled to a front side of the main body to open and close the cavity; a decorative plate disposed on a front surface of the door; a holder moveably mounted to the door; and a fixer coupled to the decorative plate such that the decorative plate is mounted to the holder, wherein the holder includes a fixer accommodation groove having an upper surface that is open such that the fixer is inserted into the fixer accommodation groove in a downward direction.

The holder may further include a stopper coupled to the fixer such that the fixer is prevented from being separated from the fixer accommodation groove.

The stopper may have an inclined surface inclined with respect to a direction in which the fixer is inserted such that the stopper moves in a direction perpendicular to the insertion direction of the fixer when the fixer is inserted into the fixer accommodation groove.

The holder may include an elastic pressing portion elastically supporting the stopper.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

As used herein, the singular forms "a," "an" and "the" are intended to include the plural forms as well, unless the context clearly indicates otherwise. although the drawings represent exemplary embodiments of the disclosure, the drawings are not necessarily to scale and certain features may be exaggerated or omitted in order to more clearly illustrate and explain the disclosure.

It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Hereinafter, the disclosure will be described in detail with reference to the accompanying drawings.

Figure 1:
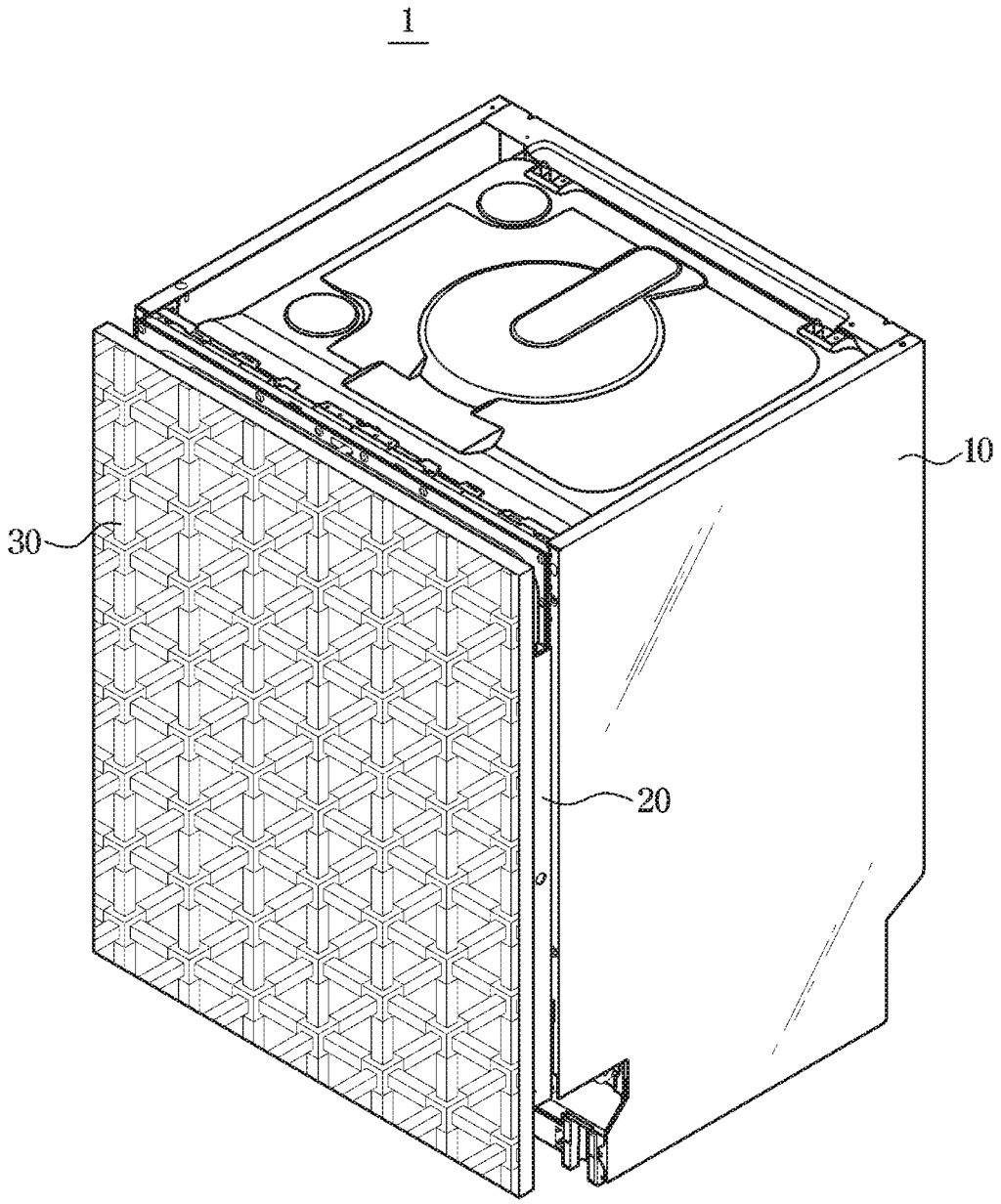
FIG. 1 is a view illustrating the external appearance of a home appliance according to an embodiment of the disclosure.
Figure 2:
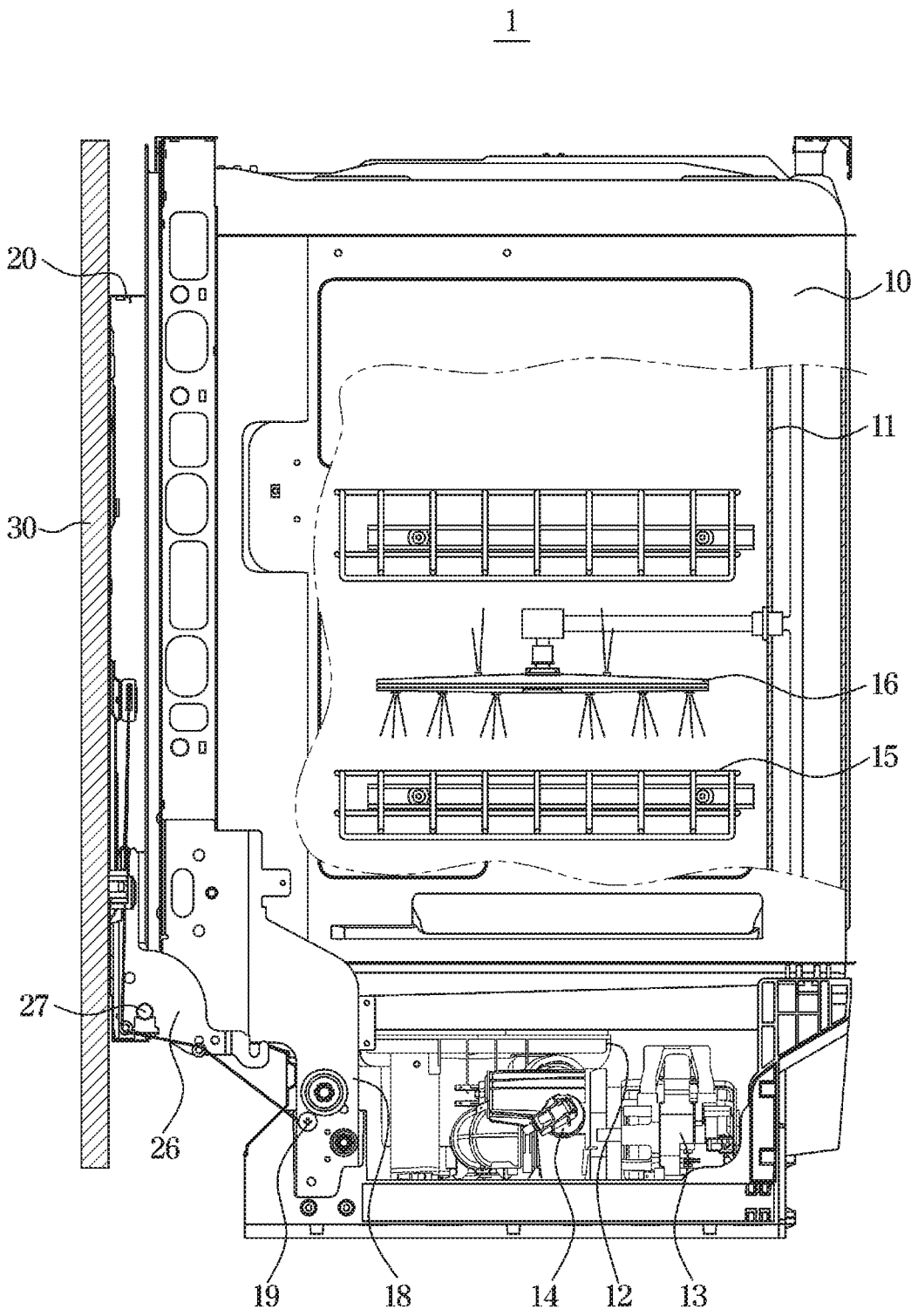
FIG. 2 is a schematic side cross-sectional view illustrating a home appliance according to an embodiment of the disclosure.

FIG. 1 is a view illustrating the external appearance of a home appliance according to an embodiment of the disclosure. FIG. 2 is a schematic side cross-sectional view illustrating a home appliance according to an embodiment of the disclosure.

Referring to FIGS. 1 and 2, the embodiment is described.

The concept of the disclosure may be applied to a home appliance 1 (an all-in-one home appliance) including: a main body 10 having a cavity 11, a front surface of which is open; and a door 20 rotatably coupled to the main body 10. Although the following description is made on a dishwasher for washing dishes by jetting wash water to dishes as an example of the home appliance 1, the home appliance 1 is not limited to the dishwasher. For example, the home appliance 1 may include a cooking device for cooking foods by applying heat or electromagnetic waves to the foods, a refrigerator for keeping foods refrigerated and frozen, and a clothes treatment device, and the like.

The cavity 11 is provided at an inside thereof with a basket 15 for storing dishes and a nozzle 16 for jetting washing water to the dishes accommodated in the basket 15. A sump 12 may be provided at a lower portion of the cavity 11 to store wash water therein. The wash water stored in the sump 12 may be guided to the nozzle 16 by a circulation pump 13 or may be discharged to the outside of the cavity 11 by a drain pump 14.

The cavity 11 may be provided in a way to be opened at a front surface through which dishes are inserted and removed, and the front surface may be opened and closed by the door 20. The door 20 may open and close the cavity 11 by rotating about a rotation shaft 27 formed at a lower portion of the door 20. A hinge bracket 26 may be coupled to the lower portion of the door 20, a fixing bracket 18 may be coupled to a lower portion of the main body 10, and the rotating shaft 27 may pass through the hinge bracket 26 and the fixing bracket 18. The fixing bracket 18 may be fixed to a fixing member 19 for fixing one end of a first wire 70, which will be described below.

The home appliance 1 may be provided in a built-in type, adjacent to furniture, such as a sink or a chest of drawers. A decorative plate 30 having a design corresponding to a design of the adjacent furniture may be attached to a front surface of the door 20.

Referring to FIG. 2, the decorative plate 30 may be formed such that a lower end thereof is positioned lower than a lower end of the door 20 to cover a space between the door 20 and the floor. Accordingly, the lower end of the decorative plate 30 may interfere with the lower portion of the main body 10 when the door 20 rotates forward.

According to the embodiment of the disclosure, the decorative plate 30 is provided to be moved in an upper direction of the door 20 when the door 20 is opened, to thereby prevent the lower end of the decorative plate 30 from interfering with the lower portion of the main body 10 when the door 20 is rotated.

Hereinafter, the structure to move the decorative plate 30 according to rotation of the door 20 will be described in detail.

Figure 3:
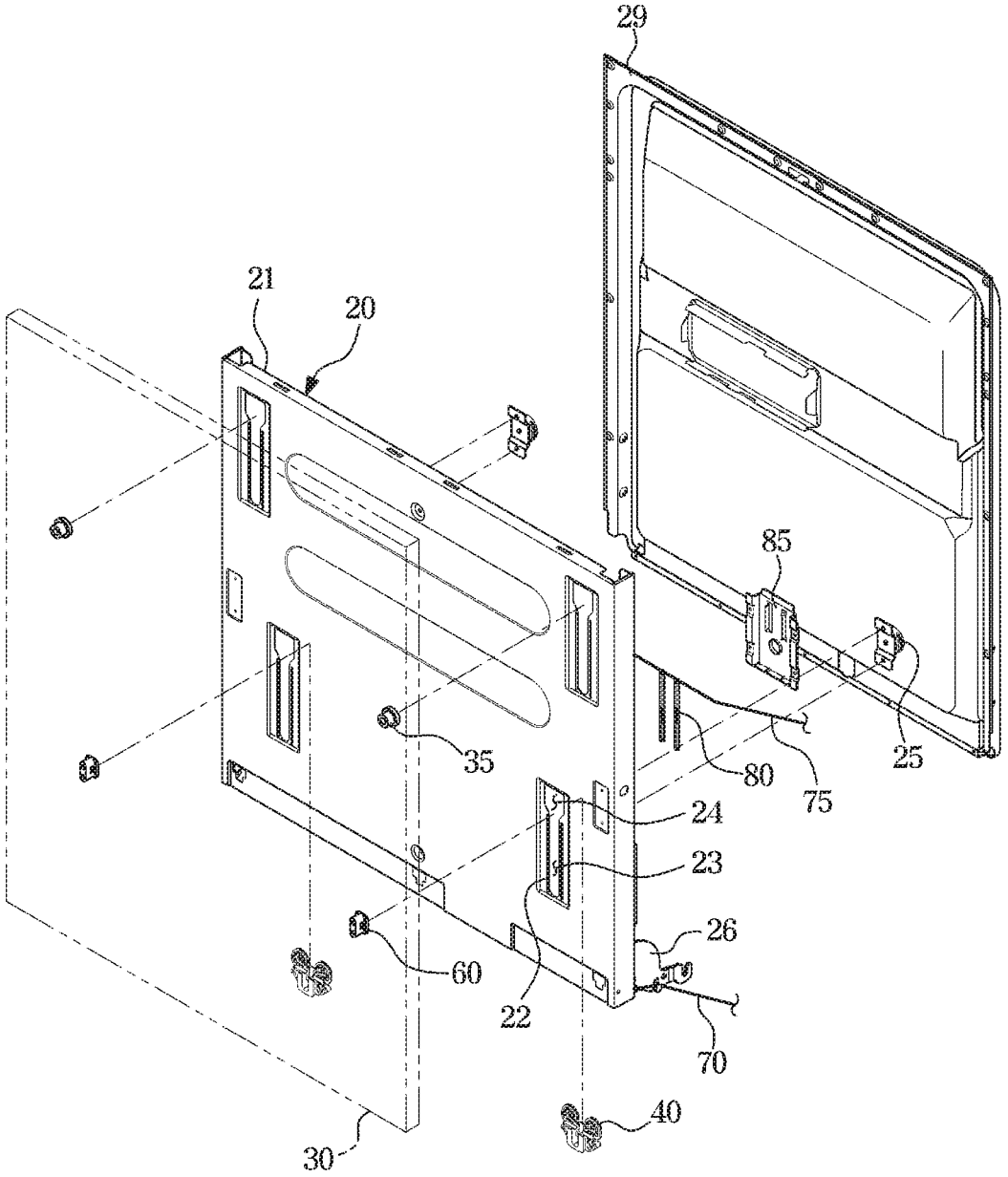
FIG. 3 is a view illustrating a door and a decorative plate of a home appliance according to an embodiment of the disclosure, which are separated from each other.
Figure 4:
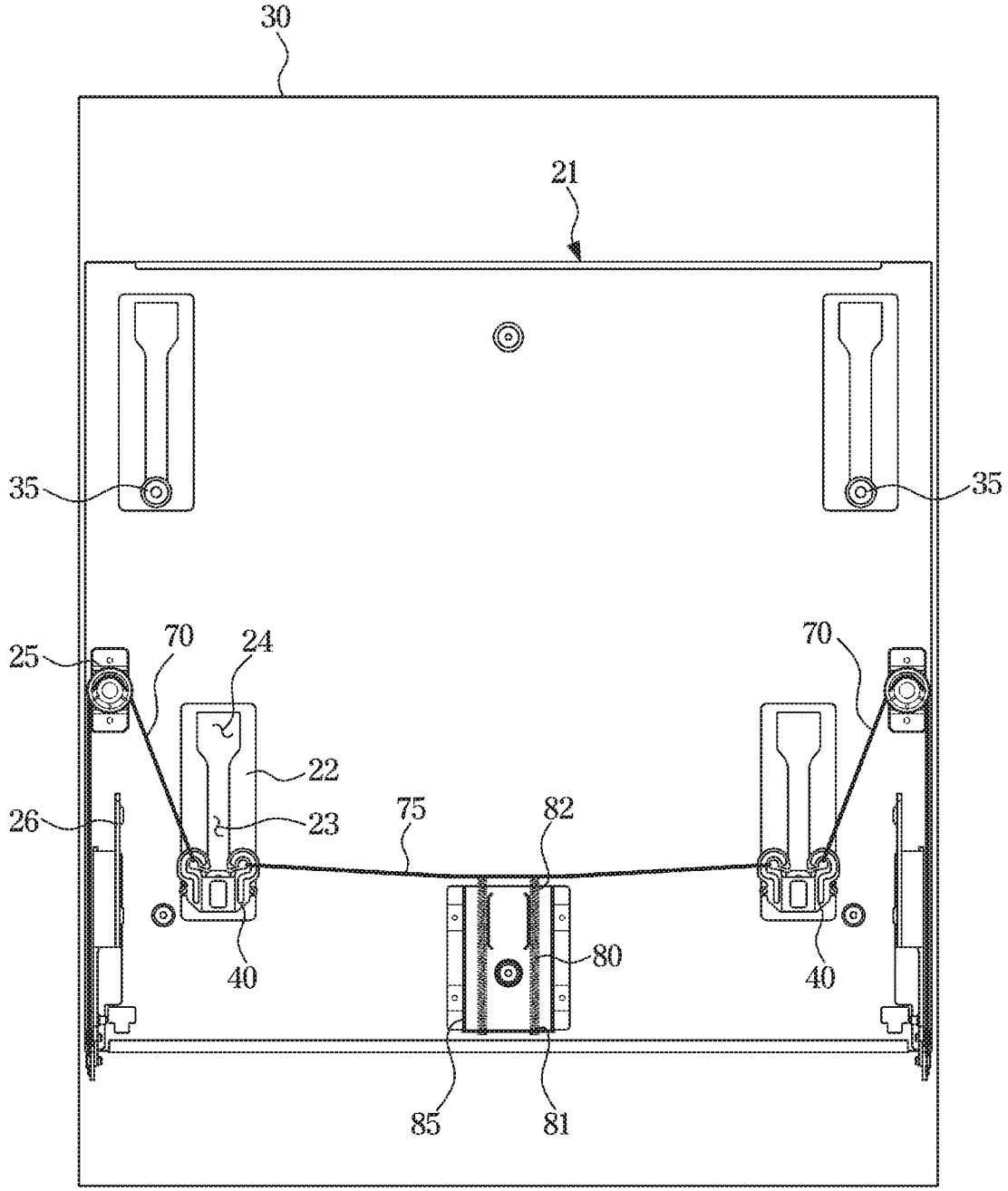
FIG. 4 is a view illustrating a rear surface of a door front plate of a home appliance according to an embodiment of the disclosure.
Figure 5:
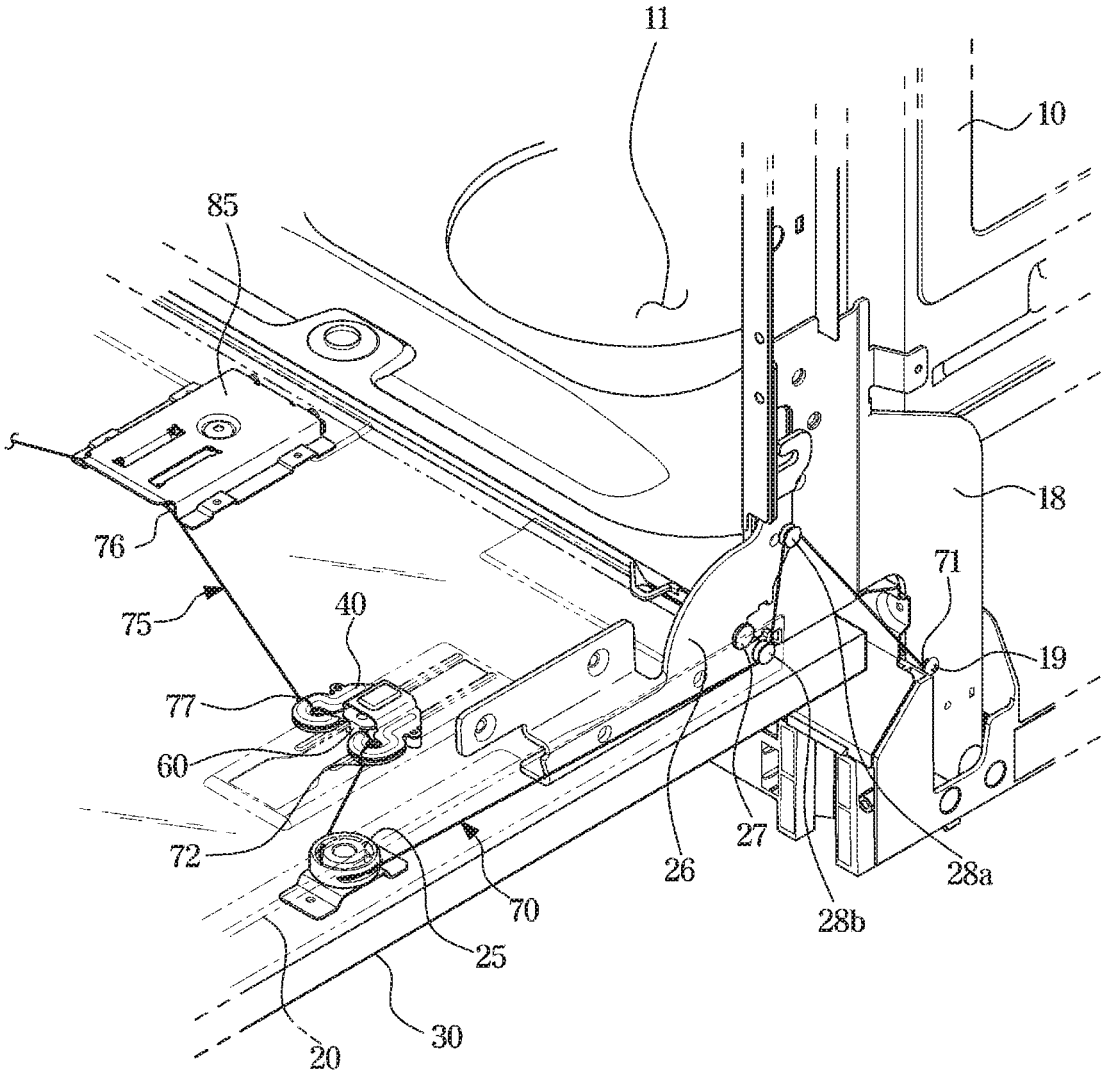
FIG. 5 is a perspective view illustrating an installation position of a wire of a home appliance according to an embodiment of the disclosure.
Figure 6:
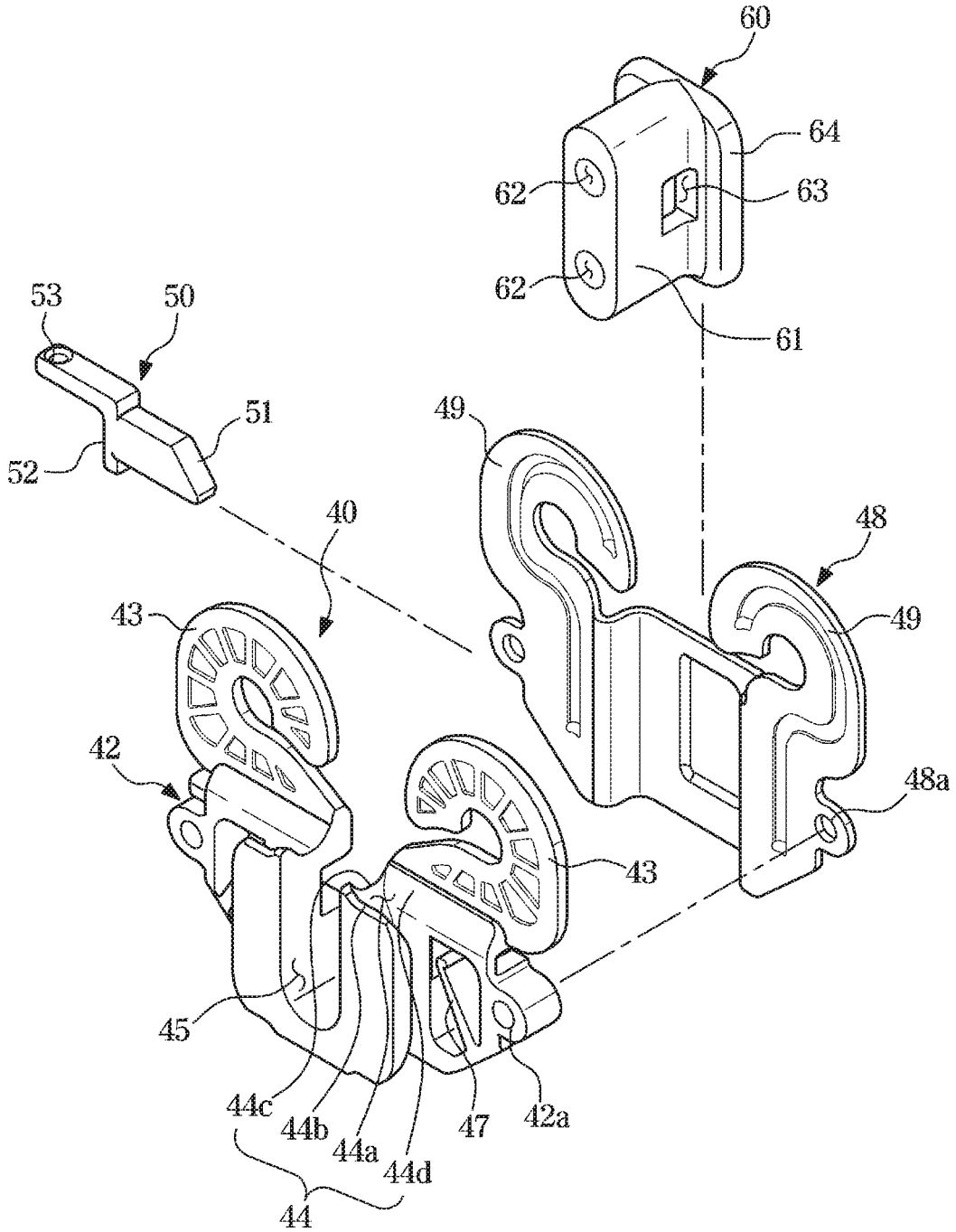
FIG. 6 is a perspective view illustrating a holder, a stopper, and a fixer of a home appliance according to an embodiment of the disclosure, which are separated from each other.
Figure 7:
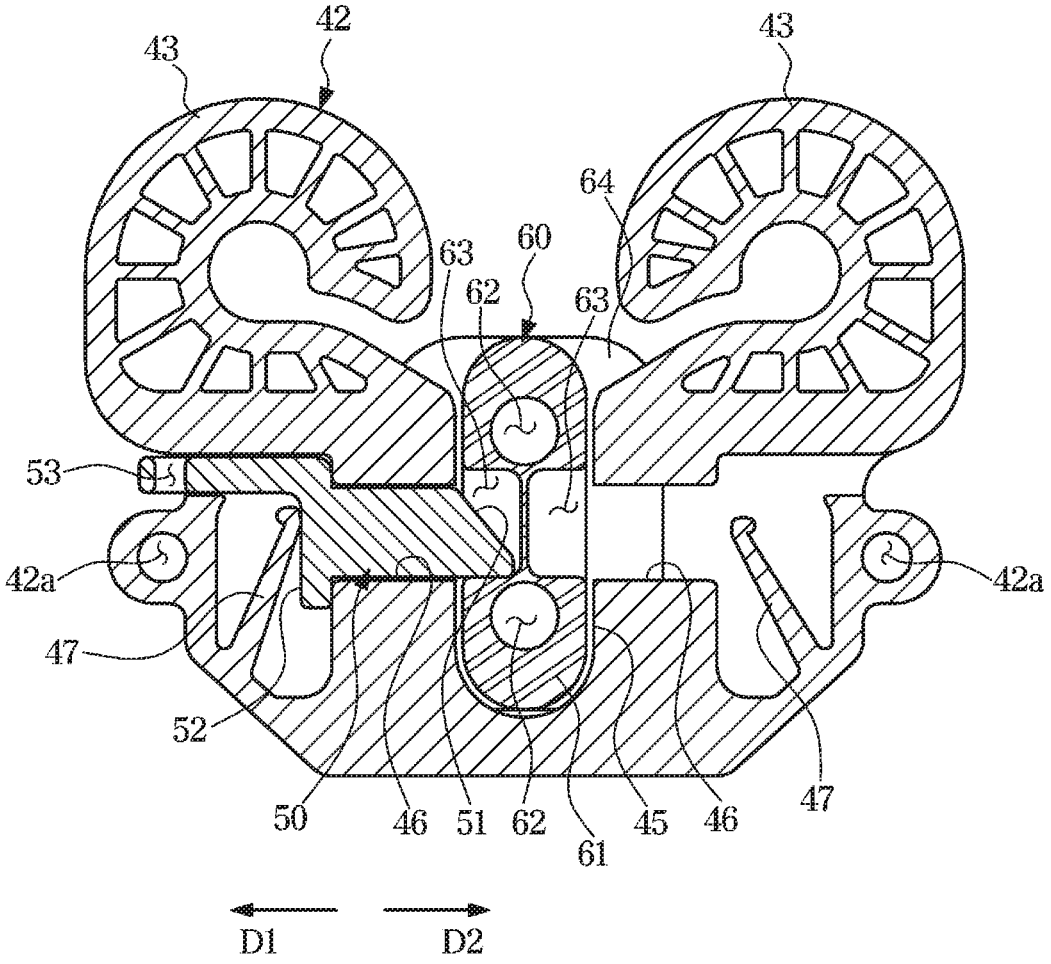
FIG. 7 is a cross-sectional view illustrating a holder, a stopper, and a fixer of a home appliance according to an embodiment of the disclosure.

FIG. 3 is a view illustrating a door and a decorative plate of a home appliance according to an embodiment of the disclosure, which are separated from each other. FIG. 4 is a view illustrating a rear surface of a door front plate of a home appliance according to an embodiment of the disclosure. FIG. 5 is a perspective view illustrating an installation position of a wire of a home appliance according to an embodiment of the disclosure. FIG. 6 is a perspective view illustrating a holder, a stopper, and a fixer of a home appliance according to an embodiment of the disclosure, which are separated from each other. FIG. 7 is a cross-sectional view illustrating a holder, a stopper, and a fixer of a home appliance according to an embodiment of the disclosure.

Referring to FIGS. 3 to 7, the home appliance 1 includes a holder 40 movably mounted to the door 20, and a first wire 70 connected to the holder 40 and the main body 10 such that a tension of the first wire 70 varies according to the rotation of the door 20 and configured to move the holder 40 by the tension.

The door 20 may be formed by assembling a door front plate 21 and a door rear plate 29. The door front plate 21 may include a guide plate 22 through which a guide slot 23 passes. The guide slot 23 may guide the movement of the holder 40. The guide slot 23 may be elongated in an upper side and lower side direction of the door 20 such that the holder 40 moves in the upper side and lower side direction of the door 20.

The guide slot 23 may be provided in a plurality of units thereof in the door front plate 21. In the embodiment, a total of four guide slots 23 are provided, but the number of the guide slots 23 according to the disclosure is not limited thereto.

The guide slots 23 may be respectively provided at an upper left portion, an upper right portion, a lower left portion, and a lower right portion of the door front plate 21. However, the position of the guide slot 23 is not limited. The holders 40 may be movably mounted in the guide slots 23 of the lower left portion and the lower right portion of the door front plate 21 among the plurality of guide slots 23.

To a rear surface of the decorative plate 30, a fixer 60 and a connecting member 35 may be coupled. Each of the fixer 60 and the connecting member 35 may be provided in a plurality of units thereof, and may be coupled to the rear surface of the decorative plate 30 to correspond to the positions of the plurality of guide slots 23. In detail, the plurality of fixers 60 are coupled to a lower portion of the rear surface of the decorative plate 30 to correspond to the guide slots 23 of the lower left and lower right portions of the door front plate 21, and the plurality of connecting members 35 may be coupled to an upper portion of the rear surface of the decorative plate 30 to correspond to the guide slots 23 of the upper left and upper right portions of the door front plate 21.

The fixers 60 may be mounted to the holders 40 mounted to the guide slots 23, and the connecting members 35 may be directly mounted to the guide slots 23.

The guide plate 22 may be formed with an expansion slot 24 having a width larger than that of the guide slot 23 such that the holder 40 is mounted to the guide slot 23. The expansion slot 24 may be formed at an upper side of the guide slot 23 while extending from the guide slot 23. In the mounting of the holder 40 to the guide slot 23, the holder 40 is inserted into the expansion slot 24 first, and then is moved downward, so that the holder 40 is mounted to the guide slot 23.

The first wire 70, a tension of which varies according to the rotation of the door 20, may be connected to the holder 40 and the main body 10. In the embodiment, the wire includes all types of connecting members formed of a flexible material on which tension may be exerted, such as a thread, a wire, a belt, a string, a rope, and the like.

In detail, one end (71 in FIG. 5) of the first wire 70 is coupled to the fixing member 19 fixed to the main body 10, and the other end (72 in FIG. 5) of the first wire 70 may be coupled to the holder 40.

Since the one end 71 of the first wire 70 is coupled to the main body 10 and the other end 72 of the first wire 70 is coupled to the holder 40 mounted to the door 20, when the door 20 is opened, a tension is applied to the first wire 70, so that the first wire 70 becomes taut. On the contrary, when the door 20 is closed, the tension applied to the first wire 70 is removed, so that the first wire 70 may be loosened.

By the tension applied to the first wire 70 when the door 20 is opened, a force may be exerted on the holder 40 connected to the first wire 70.

The home appliance 1 according to the embodiment of the disclosure may include a direction conversion member 25 that converts the direction of a force exerted on the holder 40 such that the holder 40 is moved in the upper direction of the door 20 by the tension of the first wire 70 when the door 20 is opened. The direction conversion member 25 may include all types of mechanisms that may convert the direction of a force, such as a pulley, a wheel, and the like.

The direction conversion member 25 may be disposed at a position higher than that of the holder 40 on the door 20. Accordingly, a force acting in the upper direction of the door 20 may be exerted on the holder 40 by the tension of the first wire 70. The direction conversion member 25 may be coupled to the rear surface of the door front plate 21. The first wire 70 may be provided to be hung on the direction conversion member 25.

The home appliance 1 may further include wire guide members 28*a* and 28*b* provided to guide the position of the first wire 70. The wire guide members 28*a* and 28*b* may guide the first wire 70 to be properly positioned not to interfere with other components. In the embodiment, the wire guide members 28*a* and 28*b* may be provided in a plurality of units thereof, and the number of the wire guide members 28*a* and 28*b* is not limited.

Although the wire guide members 28*a* and 28*b* may be provided in the form of a protrusion on which the first wire 70 is hung, the disclosure is not limited thereto. For example, the wire guide members 28*a* and 28*b* may be provided in the form of a pulley, a wheel, and the like.

The wire guide members 28*a* and 28*b* may be configured not only to guide the position of the first wire 70 but also to adjust the tension of the first wire 70 at a time of rotation of the door 20. That is, the wire guide members 28*a* and 28*b* may allow greater tension to be applied to the first wire 70 when the door 20 is opened.

In detail, the wire guide members 28*a* and 28*b* may cause the first wire 70 to have a large displacement when the door 20 is opened such that greater tension is applied to the first wire 70.

In the embodiment, the wire guide members 28*a* and 28*b* may be provided in the hinge bracket 26 coupled to the door 20. Accordingly, when the door 20 rotates, the wire guide members 28*a* and 28*b* may also rotate about the rotation shaft 27 of the door 20. As such, since the wire guide members 28*a* and 28*b* also rotate when the door 20 rotates, a large displacement may occur in the first wire 70.

The holder 40 may include a holder body 42 and a holder cover 48 coupled to a rear side of the holder body 42. The holder body 42 and the holder cover 48 may be coupled to each other through a fastening member, such as a screw, a pin, a bolt, and the like. To this end, the holder body 42 and the holder cover 48 may be respectively formed with fastening holes 42*a* and 48*a* to which fastening members are fastened.

The holder body 42 may include a ring portion 43 in the form of a ring to which the first wire 70 and a second wire 75 are connected. The holder cover 48 may include a ring portion 49 coupled to a rear portion of the ring portion 43 of the holder body 42. The ring portion 43 of the holder body 42 and the ring portion 49 of the holder cover 48 may be coupled to each other to form a ring portion of the holder 40.

The holder body 42 may include a rail portion 44 that is movably mounted to the guide slot 23 formed in the door front plate 21. The rail portion 44 includes a rail body 44*c* inserted into the guide slot 23, a rail head 44*b* and a rail base 44*d* extending from opposite ends of the rail body 44*c*, and a rail groove 44*a* formed by the rail head 44*b*, the rail body 44*c*, and the rail base 44*d*. The rail head 44*b*, the rail body 44*c*, and the rail base 44*d* may substantially form a shape.

The guide plate 22 formed at a periphery of the guide slot 23 may be inserted into the rail groove 44*a*, and the rail head 44*b* and the rail base 44*d* may be supported by the guide plate 22 to prevent the holder body 42 from being slipped from the guide slot 23.

The holder body 42 may include a fixer accommodation groove 45 formed to accommodate the fixer 60. The fixer accommodation groove 45 may have an upper surface that is open such that the fixer 60 is inserted in a downward direction.

With this configuration, when the decorative plate 30 is desired to be mounted to the door 20, the fixer 60 is coupled to the rear surface of the decorative plate 30, and the decorative plate 30 is moved such that the fixer 60 is adjacent to the fixer accommodation groove 45 of the holder 40 mounted to the door 20 and then is laid downward, so that the decorative plate 30 is easily mounted to the door 20.

The holder 40 may include a stopper 50 coupled to the fixer 60 to prevent the fixer 60 from being separated from the fixer accommodation groove 45. To this end, the holder body 42 has a stopper accommodation groove 46 in which the stopper 50 is accommodated, and the fixer 60 has a locking groove 63 to which the stopper 50 is coupled. Although only one stopper 50 is illustrated in the drawing of the embodiment, a plurality of the stoppers 50 may be provided on the left and right sides of the holder 40.

With the stopper 50 inserted into the stopper accommodation groove 46 of the holder body 42, the holder cover 48 may be coupled to the rear portion of the holder body 42.

The stopper 50 may be provided to be movable in the left side and right side direction in the stopper accommodation groove 46. That is, the stopper 50 may be moved in a first direction perpendicular to a direction in which the fixer 60 is inserted into the fixer accommodation groove 45, when the fixer 60 is inserted into the fixer accommodation groove 45. To this end, the stopper 50 may have an inclined surface 51 inclined with respect to the insertion direction of the fixer 60.

The holder body 42 may be provided with an elastic pressing portion 47 that extends to elastically support the stopper 50. The elastic pressing portion 47 may apply a force to a support portion 52 of the stopper 50 in a second direction opposite to the first direction The elastic pressing portion 47 may be elastically deformed in the first direction during the fixer 60 being mounted to the fixer accommodation groove 45 while accumulate elastic force. When the mounting of the fixer 60 to the fixer accommodation groove 45 is completed, the elastic pressing portion 47 is restored to press the stopper 50 in the second direction such that the stopper 50 is inserted into the locking groove 63 of the fixer 60. Accordingly, the fixer 60 may be prevented from being separated from the fixer accommodation groove 45, and as a result, the decorative plate 30 may be prevented from being separated from the door 20.

On the contrary, in the separating of the decorative plate 30 from the door 20, the stopper 50 needs to be removed from the locking groove 63. Accordingly, the stopper 50 may be provided with a separation wire coupling groove 53 with which the stopper 50 is pulled out to be removed from the locking groove 63.

A wire, a tong, a pin, or the like is connected to the separating wire coupling groove 53, and then is pulled out with a force greater than the elastic force of the elastic pressing portion 47, so that the stopper 50 may be separated from the locking groove 63. As such, according to the embodiment of the disclosure, the decorative plate 30 may be easily separated from the door 20.

The fixer 60 is a component for attaching the decorative plate 30 to the holder 40. The fixer 60 may be coupled to the rear surface of the decorative plate 30. The fixer 60 may be coupled to the decorative plate 30 through a fastening member. To this end, the fixer 60 may be provided with a fastening hole 62 to which a fastening member is fastened.

The fixer 60 may include a fixer body 61 having the fastening hole 62 and the locking groove 63, and a fixer wing 64 extending from a rear end portion of the fixer body 61. The fixer wing 64 allows the fixer 60 to be accurately positioned when the fixer 60 is inserted into the fixer accommodation groove 45 of the holder 40, and allows the fixer 60, once inserted into the fixer accommodation groove 45, to be more stably supported.

As described above, tension is applied to the first wire 70 when the door 20 is opened, and the holder 40 is moved in the upper direction of the door 20 along the guide slot 23 by the tension of the first wire 70, so that the decorative plate 30 is moved in the upper direction of the door 20.

Since the door 20 is vertically disposed when the door 20 is closed, the decorative plate 30 disposed on the front surface of the door 20 may be moved in the lower direction of the door 20 by the self-weight.

The home appliance 1 may further include the second wire 75 connected to the holder 40 to move the holder 40 in the lower direction of the door 20 when the door 20 is closed. However, as described above, since the decorative plate 30 is movable in the lower direction of the door 20 by the self-weight when the door 20 is closed, the second wire 75 may be omitted.

The door 20 may be provided with an elastic member 80, such as a spring, for elastically supporting the second wire 75. The door 20 may be provided with an installation bracket 85 for covering the elastic member 80 and fixing one end 81 of the elastic member 80. The one end 81 of the elastic member 80 may be coupled to the installation bracket 85 and the other end 82 of the elastic member 80 may be coupled to the second wire 75.

One end 76 of the second wire 75 may be coupled to the elastic member 80, and the other end 77 may be coupled to the holder 40.

With this configuration, when the door 20 is opened, the holder 40 is moved in the upper direction of the door 20, so that tension is applied to the second wire 75, and the elastic member 80 may be extended by the tension of the second wire 75. When the door 20 is closed, the elastic member 80 is contracted to pull the second wire 75 such that the holder 40 may be moved in the lower direction of the door 20.

Figure 8:
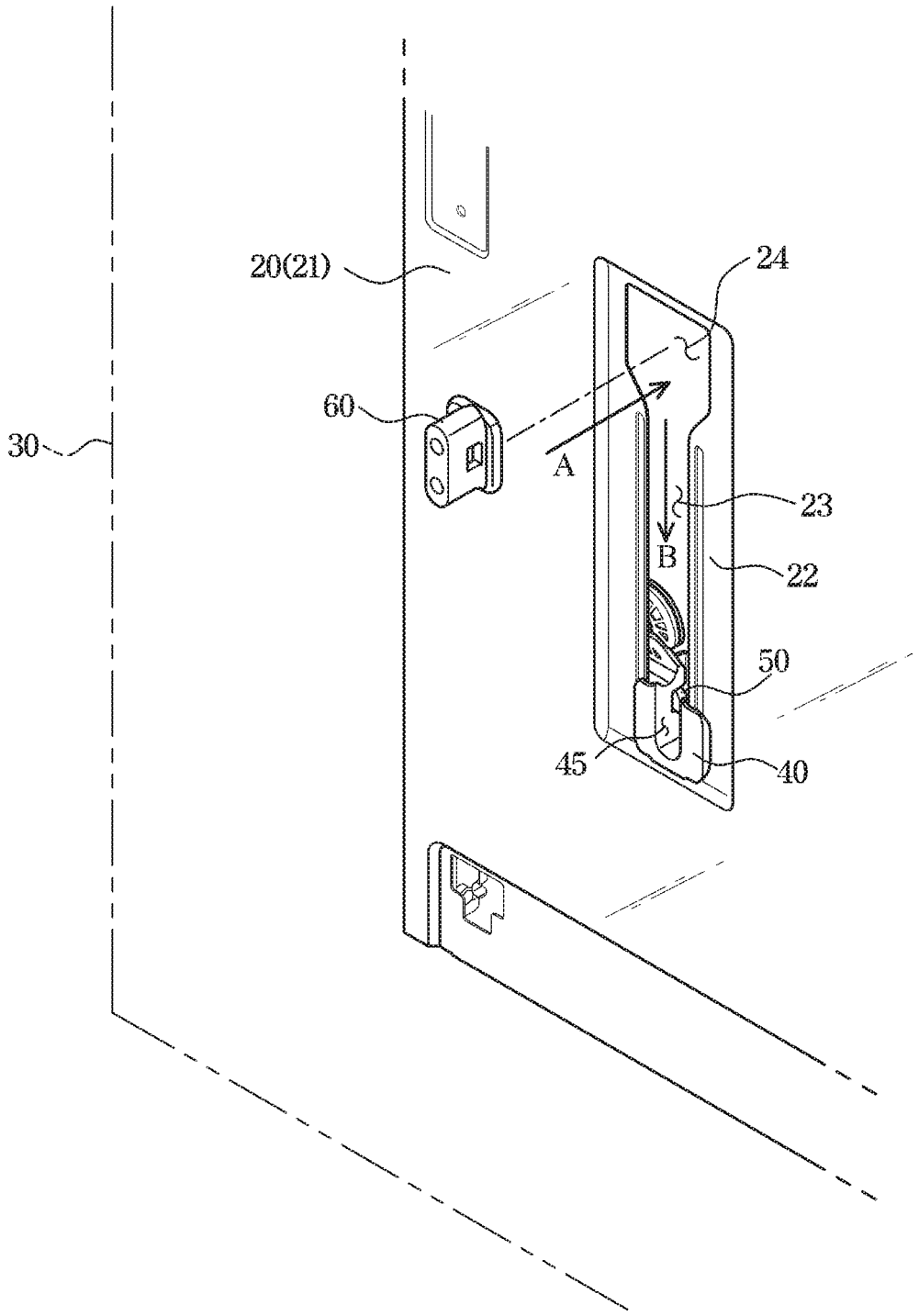
FIG. 8 is a view for describing an operation of attaching a decorative plate of a home appliance to a door according to an embodiment of the disclosure.
Figure 9:
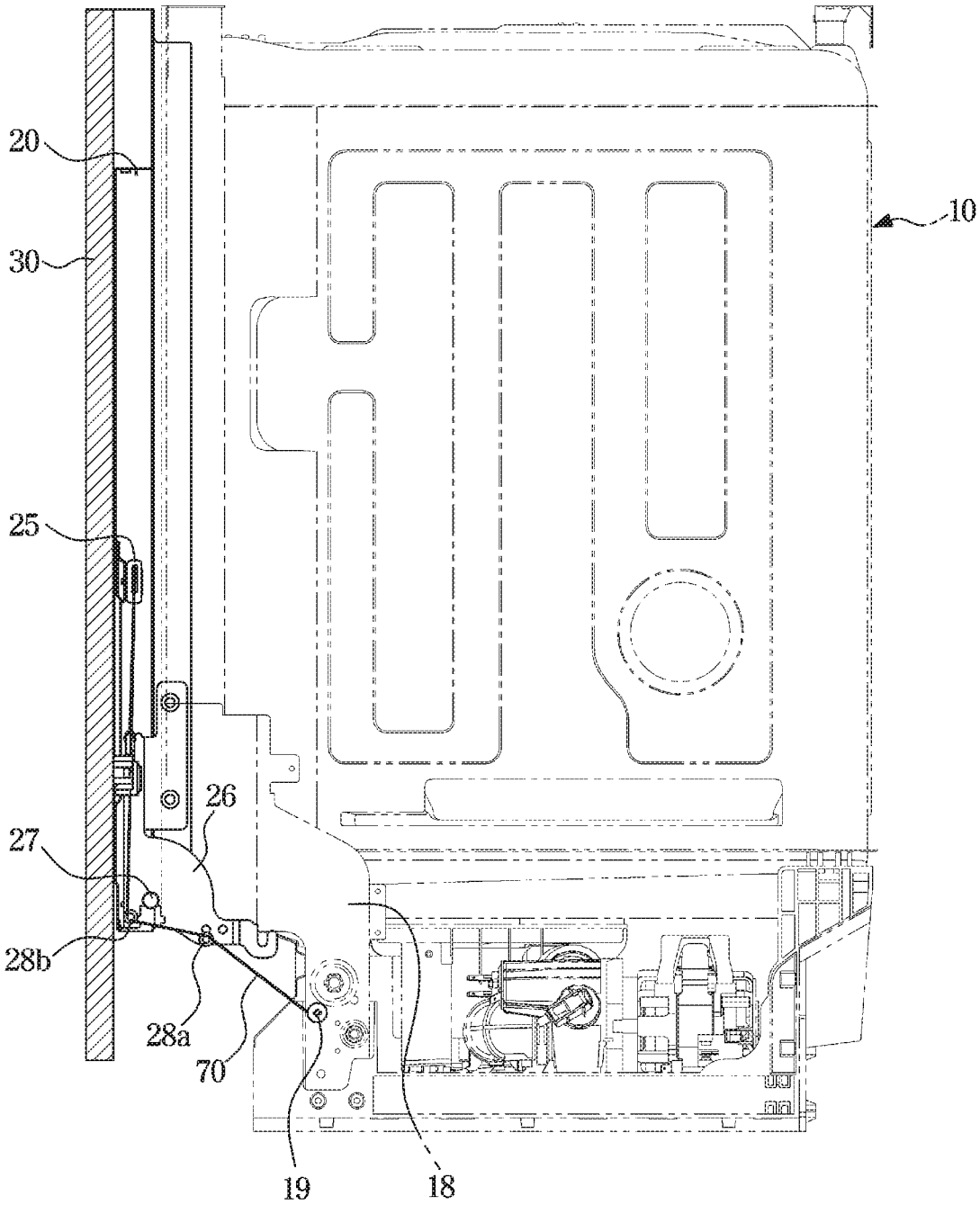
FIG. 9 is a view illustrating a closed state of a door of a home appliance according to an embodiment of the disclosure.
Figure 10:
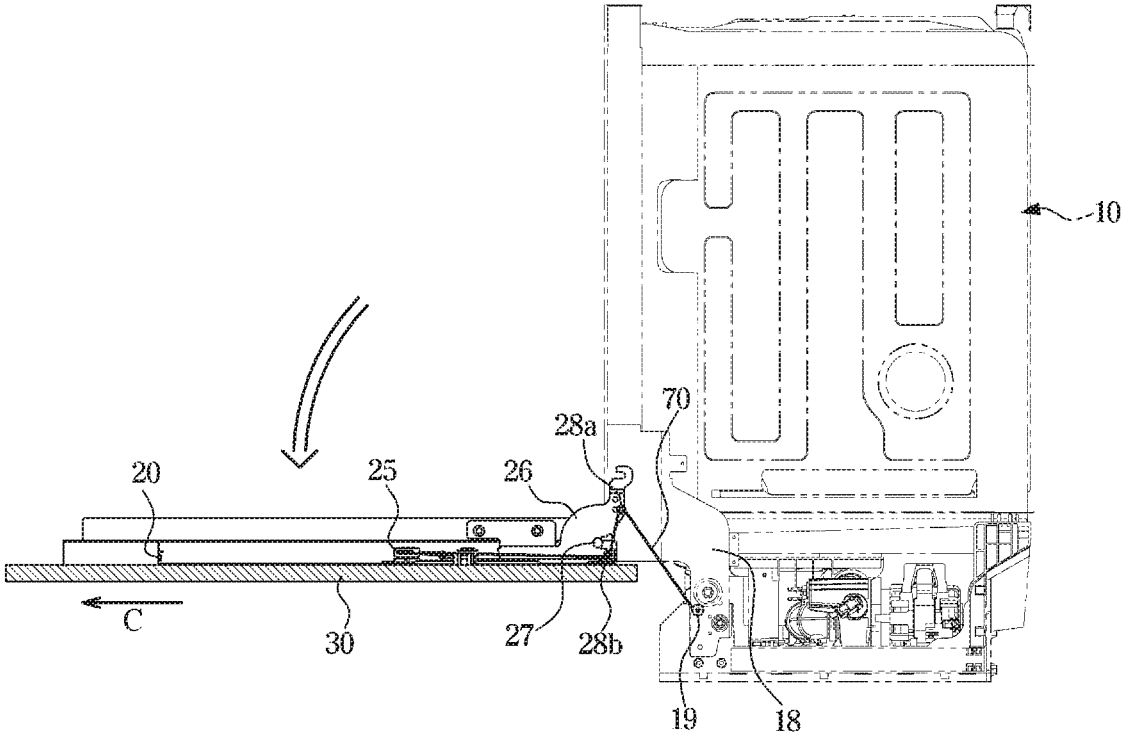
FIG. 10 is a view illustrating an open state of a door of a home appliance according to an embodiment of the disclosure.

FIG. 8 is a view for describing an operation of attaching a decorative plate of a home appliance to a door according to an embodiment of the disclosure. FIG. 9 is a view illustrating a closed state of a door of a home appliance according to an embodiment of the disclosure. FIG. 10 is a view illustrating an open state of door of a home appliance according to an embodiment of the disclosure.

An operation of attaching the decorative plate to the door of the home appliance according to the embodiment of the disclosure, and an operation of moving the decorative plate at a time of opening and closing the door will be described in brief with reference to FIGS. 8 to 10.

Referring to FIG. 8, in order to attach the decorative plate 30 to the door 20, the holder 40 is first mounted to the guide slot 23 of the door 20.

In the mounting of the holder 40 to the guide slot 23, the holder 40 is inserted into the expansion slot 24 extending at the upper side of the guide slot 23, and then is moved downward, so that the holder 40 is mounted to the guide slot 23.

Thereafter, the fixer 60 is fixed to the rear surface of the decorative plate 30. The fixer 60 may be firmly fixed to the rear surface of the decorative plate 30 through a fastening member.

Thereafter, the fixer 60 fixed to the decorative plate 30 is moved in a direction A toward the holder 40 and then is moved in a lower direction B, so that the fixer 60 is inserted into the fixer accommodation groove 45 of the holder 40 and thus is mounted. When the insertion of the fixer 60 into the fixer accommodation groove 45 of the holder 40, the stopper 50 of the holder 40 is fastened to the locking groove 63 of the fixer 50, so that the fixer 50 is prevented from being separated from the holder 40.

Referring to FIG. 10, when the door 20 is opened by being rotated forward, tension is applied to the first wire 70 connected to the holder 40 and the main body 10, and a force acting in the upper direction C of the door 20 is exerted on the holder 40 by the tension of the first wire 70. The holder 40 is moved in the upper direction C of the door 20 along the guide slot 23, and accordingly, the decorative plate 30 may be moved in the upper direction C of the door 20.

When the door 20 is closed again, the decorative plate 30 may be moved to the original position due to the self-weight of the decorative plate 30 and the tension of the second wire 75.

As is apparent from the above, the decorative plate attached to the front surface of the door is moved in an upper direction of the door when the door is opened, so that the decorative plate can be prevented from interfering with the lower portion of the main body.

The decorative plate can be easily mounted to or separated from the door without using a separate fastening member.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A home appliance comprising:

a main body having a cavity;

a door rotatably coupled to a front side of the main body to open and close the cavity;

a holder moveably mounted to the door and having an accommodation groove with an open upper surface;

a decorative plate;

a fixer coupled to the decorative plate and being insertable in a downward direction into the open upper surface of the accommodation groove to be accommodated in the accommodation groove, to thereby mount the decorative plate to the holder so that the decorative plate is disposed on a front surface of the door; and a wire connected to the holder and the main body so that, with the decorative plate mounted to the holder, rotation of the door varies tension of the wire, which thereby moves the holder, which thereby moves the decorative plate.

2. The home appliance of claim 1, wherein the tension applies a force to the holder when the door is opened, and the is force is removed from the holder when the door is closed.

3. The home appliance of claim 1, wherein the holder is moved in an upper direction of the door by the tension of the wire when the door is opened.

4. The home appliance of claim 3, wherein the decorative plate, while mounted to the holder, is moved in a lower direction of the door by self-weight of the decorative plate when the door is closed.

5. The home appliance of claim 1, wherein the door is provided with a guide slot for guiding movement of the holder, and the holder is inserted into the guide slot and moves along the guide slot.

6. The home appliance of claim 1, further comprising:

a direction conversion member configured to convert a direction of a force exerted on the holder by the tension of the wire.

7. The home appliance of claim 1, further comprising:

a wire guide member configured to guide a position of the wire.

8. The home appliance of claim 7, wherein the wire guide member is configured to adjust the tension of the wire at a time of rotation of the door.

9. The home appliance of claim 1, further comprising:

another wire connected to the holder such that the holder is moved in a lower direction of the door when the door is closed.

10. The home appliance of claim 9, further comprising:

an elastic member connected to the another wire to elastically support the another wire.

11. The home appliance of claim 10, further comprising:

an installation bracket coupled to the door to cover and support the elastic member.

12. The home appliance of claim 1, wherein the holder further includes a stopper that couples to the fixer so that, while the fixer is accommodated in the accommodation groove, the fixer is prevented from being separated from the accommodation groove.

13. The home appliance of claim 12, wherein the holder includes an elastic pressing portion elastically supporting the stopper.

14. A home appliance comprising:

a main body having a cavity;

a door rotatably coupled to a front side of the main body to open and close the cavity;

a holder moveably mounted to the door and having a fixer accommodation groove with an open upper surface; and a fixer that is insertable into the open upper surface of the fixer accommodation groove in a downward direction to be accommodated in the fixer accommodation groove, wherein the fixer is configured to, while being accommodated in the fixer accommodation groove, couple a decorative plate to the holder so that the decorative plate is disposed on a front surface of the door, the holder further includes a stopper that couples to the fixer so that, while the fixer is accommodated in the fixer accommodation groove, the fixer is prevented from being separated from the fixer accommodation groove, and the stopper has an inclined surface inclined with respect to the downward direction in which the fixer is insertable into the open upper surface of the fixer accommodation groove, so that the stopper moves in a direction perpendicular to the insertion direction when the fixer is inserted into the open upper surface of the fixer accommodation groove.

15. The home appliance of claim 14, wherein the holder includes an elastic pressing portion elastically supporting the stopper.

16. A home appliance comprising:

a main body having a cavity;

a door rotatably coupled to a front side of the main body to open and close the cavity;

a holder moveably mounted to the door and having an accommodation groove with an open upper surface into which a fixer coupled to a decorative plate is insertable in a downward direction to be accommodated in the accommodation groove, to thereby mount the decorative plate to the holder so that the decorative plate is disposed on a front surface of the door; and a wire connected to the holder and the main body so that, with the decorative plate mounted to the holder, rotation of the door varies tension of the wire, which thereby moves the holder, which thereby moves the decorative plate.

* * * * *